US008029955B2

(12) United States Patent
Sakai et al.

(10) Patent No.: US 8,029,955 B2
(45) Date of Patent: Oct. 4, 2011

(54) ELECTROPHOTOGRAPHIC PHOTORECEPTOR AND IMAGE FORMING METHOD

(75) Inventors: Eiichi Sakai, Yokohama (JP); Yoshihiko Eto, Hachioji (JP); Kimiyuki Itou, Hino (JP); Akihiko Itami, Hachioji (JP); Takeo Oshiba, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 435 days.

(21) Appl. No.: 12/361,642

(22) Filed: Jan. 29, 2009

(65) Prior Publication Data

US 2009/0197195 A1 Aug. 6, 2009

(30) Foreign Application Priority Data

Feb. 1, 2008 (JP) ..... 2008-022590

(51) Int. Cl.
*G03G 15/00* (2006.01)

(52) U.S. Cl. ..... 430/57.3; 430/56; 430/69; 430/75; 430/76; 430/77; 430/78

(58) Field of Classification Search ..... 430/56, 430/57.3, 69, 75, 76, 77, 78
See application file for complete search history.

(56) References Cited

U.S. PATENT DOCUMENTS

2001/0006755 A1* 7/2001 Itami et al. ..... 430/59.5
2004/0265016 A1* 12/2004 Kitani et al. ..... 399/298

FOREIGN PATENT DOCUMENTS

JP 2007-218403 A 8/2007
JP 2007-232794 A 9/2007

* cited by examiner

*Primary Examiner* — Hoa Le
(74) *Attorney, Agent, or Firm* — Buchanan Ingersoll & Rooney PC

(57) ABSTRACT

Provide is an electrophotographic photoreceptor exhibiting excellent evenness of halftone images together with fine line reproduction, and an image forming method thereof, as to a photoreceptor in which an oxytitanium phthalocyanine pigment having a maximum diffraction peak at a Bragg angle (2θ±0.2°) of 27.2° in CuKα X-ray diffraction. Also disclosed is an electrophotographic photoreceptor possessing a body having cylindrical conductive support provided thereon photosensitive layer containing oxytitanium phthalocyanine pigment having maximum diffraction peak at a Bragg angle (2θ±0.2°) of 27.2° in CuKα X-ray diffraction, and flanges jointed at both ends of the body, wherein at least one of flanges is fitted with driving shaft having drive hole having at least 3 sides, and a ratio B/A of cross-sectional area B of engaging part of rotation shaft to rotate the electrophotographic photoreceptor with respect to cross-sectional area A of the drive hole is 0.890-0.998.

9 Claims, 6 Drawing Sheets

ELECTROPHOTOGRAPHIC PHOTORECEPTOR AND IMAGE FORMING METHOD

This application claims priority from Japanese Patent Application No. 2008-022590 filed on Feb. 1, 2008, which is incorporated hereinto by reference.

TECHNICAL FIELD

The present invention relates to an electrophotographic photoreceptor possessing a photosensitive layer containing oxytitanium phthalocyanine having a maximum diffraction peak at a Bragg angle (2θ±0.2°) of 27.2° in CuKα X-ray diffraction, and an image forming method thereof.

BACKGROUND

The main subject concerning a photoreceptor has been moved from an inorganic photoreceptor of Se, As, As—Se alloy, CdS, ZnO or the like to an organic photoreceptor producing the advantage in the environmental pollution, or easiness of production, and organic photoreceptors employing various kinds of materials are developed.

Recently, function separation type photoreceptors in which different materials take in charge of functions for charge generation and charge transport are of a main stream, and of these, a multilayer type organic photoreceptor in which a charge generation layer and a charge transport layer are laminated is widely utilized.

Further, turning to an electrophotographic process, an image forming technique of a latent image is broadly divided into analog image formation employing a halogen lamp as a light source and digital image formation employing a LED or a laser as a light source. The digital image formation technique of a latent image is being rapidly favored for a printer for hard copy with a personal computer nowadays or a conventional copier in view of easiness of an image processing and easiness of development to a complex machine.

In the case of the digital image formation, a laser, or specifically a semiconductor laser or a LED is employed as a light source at a time when image information converted into a digital electric signal is written on a photoreceptor as a latent image.

Near-infrared light having a wavelength of 780 nm or 660 nm or long wavelength light close to it tends to be used for emission wavelengths of these laser light and LED light. Thus, as an organic photoreceptor used during digital image formation, high sensitivity should be obtained with respect to the long wavelength light, and studies concerning whether or not such the property is produced in what kind of material among various substances have been done. Since a phthalocyanine pigment among them is comparatively synthesized simply, and tends to exhibit high sensitivity with respect to long wavelength light, an organic photoreceptor in which an oxytitanium phthalocyanine pigment as a phthalocyanine pigment is utilized has widely been studied, and also been practically available. Concerning the oxytitanium phthalocyanine pigment, specifically an oxytitanium phthalocyanine pigment having a maximum diffraction peak at a Bragg angle (2θ±0.2°) of 27.2° in CuKα X-ray diffraction (hereinafter, also referred to simply as an oxytitanium phthalocyanine pigment) exhibits high sensitivity, and has practically been available.

Since an electrostatic latent image is written on the circumferential surface of a photoreceptor by usually fixing a light source, and rotating the photoreceptor when writing on the photoreceptor as the electrostatic latent image, an exposure position for writing on the photoreceptor surface is displaced in the case of insufficient rotation runout accuracy of the photoreceptor, whereby image reproduction is degraded, resulting in quality degradation. Therefore, the fine line image is deteriorated. Specifically, in the case of a tandem system full-color image forming apparatus equipped with 4 photoreceptors placed together, when rotation runout via rotation of each of 4 photoreceptors is produced, "out of color registration" is generated, and evenness of the color image is deteriorated, whereby image quality is degraded. Also in the case of a monochromatic image forming apparatus equipped with a single photoreceptor, density unevenness is generated, resulting in degradation of image quality. Thus, the stable rotation of the photoreceptor is favored, and this has been studied so far. For example, known is a method of stably rotating a photoreceptor by engaging a groove portion provided on a flange with a protrusion of a drive shaft fitted with a gear for rotation (refer to Patent Document 1, for example).

Also known is a method of rotating a photoreceptor via jointing of a coupling member provided at the tip of the drive shaft with a coupling member provided on the photoreceptor drive shaft employing a compression spring (refer to Patent Document 2, for example).

However, it was confirmed that the drive shaft was loaded since the photoreceptor was rotated via communication of driving of the drive shaft on the surface to engage the drive shaft with the flange, resulting in the limited number of rotations of the photoreceptor and rotation runout generated in rotation of the photoreceptor. Therefore, properties of a high sensitivity oxytitanium phthalocyanine pigment having a maximum diffraction peak at a Bragg angle (2θ±0.2°) of 27.2° in CuKα X-ray diffraction, capable of forming a high-speed image do not max out.

From such the situation, an image forming method employing an image forming apparatus fitted with a photoreceptor exhibiting excellent image reproduction together with no rotation runout during image formation, in which an oxytitanium phthalocyanine pigment having a maximum diffraction peak at a Bragg angle (2θ±0.2°) of 27.2° in CuKα X-ray diffraction is utilized, and the photoreceptor in which an oxytitanium phthalocyanine pigment having a maximum diffraction peak at a Bragg angle (2θ±0.2°) of 27.2° in CuKα X-ray diffraction is utilized are desired to be developed.

(Patent Document 1) Japanese Patent O.P.I. Publication No. 2007-232794

(Patent Document 2) Japanese Patent O.P.I. Publication No. 2007-218403

SUMMARY

The present invention was made on the basis of the above-described situation, and it is an object of the present invention to provide an electrophotographic photoreceptor exhibiting excellent evenness of halftone images together with fine line reproduction, and an image forming method thereof, as to a photoreceptor in which an oxytitanium phthalocyanine pigment having a maximum diffraction peak at a Bragg angle (2θ±0.2°) of 27.2° in CuKα X-ray diffraction.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIG. 3(*b*) is a schematic cross-sectional view along A-A' in FIG. 3(*a*); each of FIGS. 4(*a*), 4(*b*) and 4(*c*) is a partial schematic diagram showing a situation where a drive hole formed in a driving shaft of the electrophotographic photoreceptor shown in FIGS. 3(*a*) and 3(*b*) is engaged with a rotation shaft of an image forming apparatus; each of FIGS. 5(*a*), 5(*b*), 5(*c*), 5(*d*), 5(*e*) and 5(*f*) is a schematic elevation diagram showing shape of the drive hole shown in FIGS. 3(*a*) and 3(*b*)

DESCRIPTION OF THE PREFERRED EMBODIMENTS

Figure 1:
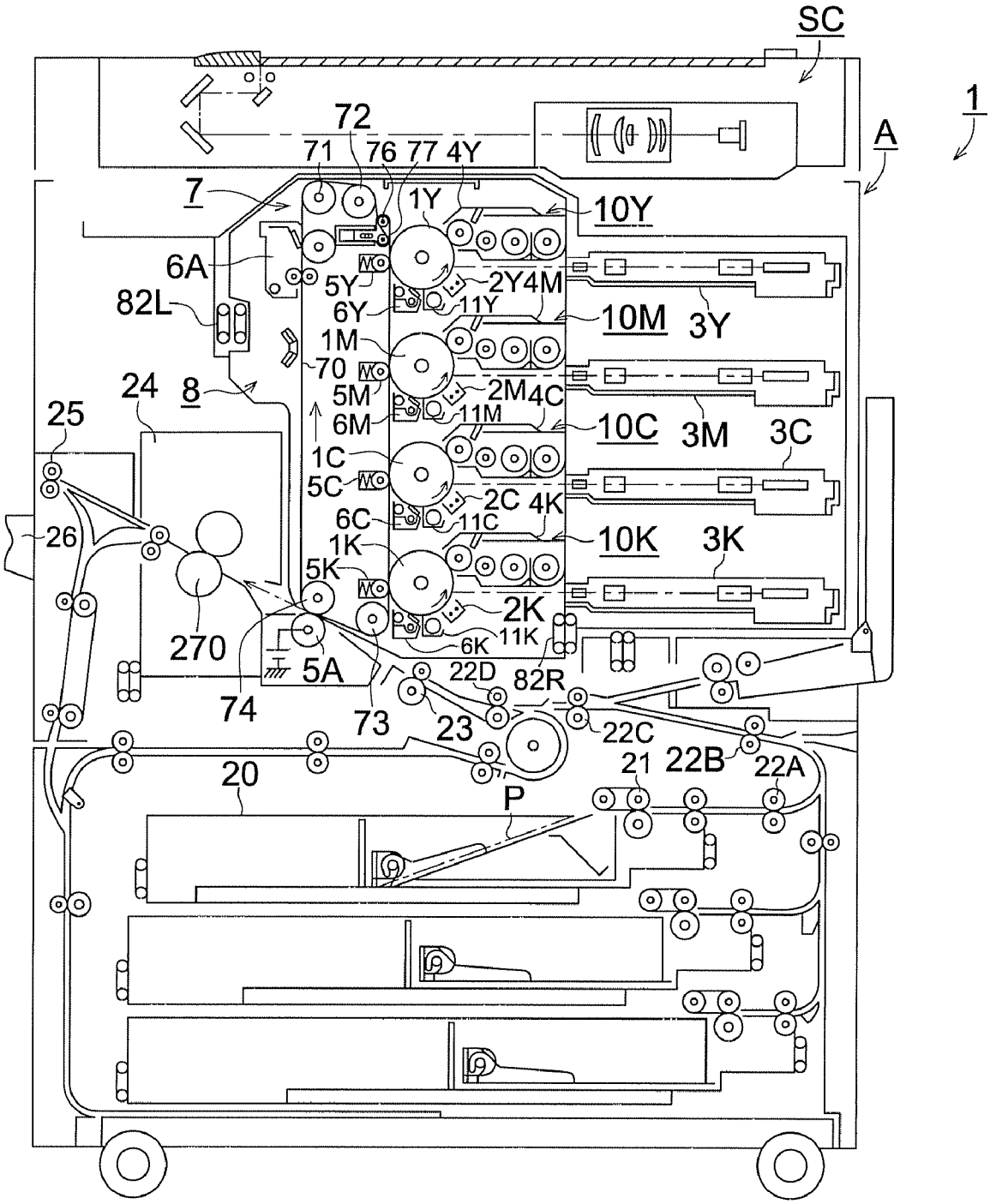
FIG. 1 is a schematic cross-sectional diagram showing an example of a full-color image forming apparatus; each of FIGS. 2(*a*), 2(*b*), 2(*c*), 2(*d*), 2(*e*) and 2(*f*) is a schematic cross-sectional diagram showing an example of the layer structure of the body possessing a photosensitive layer.

The above object of the present invention is accomplished by the following structures.

(Structure 1) An electrophotographic photoreceptor comprising a body comprising a cylindrical conductive support provided thereon a photosensitive layer containing an oxytitanium phthalocyanine pigment having a maximum diffraction peak at a Bragg angle (2θ±0.2°) of 27.2° in CuKα X-ray diffraction, and flanges jointed at both ends of the body, wherein at least one of the flanges is fitted with a driving shaft having a drive hole having at least 3 sides, and a ratio B/A of a cross-sectional area B of an engaging part of a rotation shaft to rotate the electrophotographic photoreceptor with respect to another cross-sectional area A of the drive hole is 0.890-0.998.

(Structure 2) The electrophotographic photoreceptor of Structure 1, wherein rotation runout accuracy F of the electrophotographic photoreceptor in relation to image-writing dot diameter P satisfies the following Inequality (1):

$$F/P<0.50. \qquad \text{Inequality (1)}$$

(Structure 3) The electrophotographic photoreceptor of Structure 1, wherein rotation runout accuracy F of the electrophotographic photoreceptor in relation to image-writing dot diameter P satisfies the following Inequality (2):

$$0.05<F/P<0.50. \qquad \text{Inequality (2)}$$

(Structure 4) The electrophotographic photoreceptor of any one of Structures 1-3, having a rotation runout accuracy of 10-40 μm.

(Structure 5) The electrophotographic photoreceptor of any one of Structures 1-4, wherein each of the flanges has a driving shaft length of 2-40 mm.

(Structure 6) The electrophotographic photoreceptor of any one of Structures 1-5, wherein each of the flanges has a drive hole depth of 4-60 mm.

(Structure 7) The electrophotographic photoreceptor of any one of Structures 1-6, wherein each of the flanges has a driving shaft diameter of 15-100%, based on a flange diameter.

(Structure 8) The electrophotographic photoreceptor of any one of Structures 1-7, wherein each of the flanges has a drive hole cross-sectional area of 20-90%, based on a surface area of a surface to provide the driving shaft.

(Structure 9) An image forming method comprising the steps of charging a cylindrical electrophotographic photoreceptor; conducting an exposure process to form an electrostatic latent image on the charged electrophotographic photoreceptor; conducting a developing process to visualize the electrostatic latent image formed on the electrophotographic photoreceptor to a toner image; transferring the toner image onto a transfer medium; and conducting a cleaning process to remove the toner remaining on the electrophotographic photoreceptor from the electrophotographic photoreceptor, wherein the electrophotographic photoreceptor comprises an electrophotographic photoreceptor of any one of Structures 1-8.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Embodiments of the present invention will be described referring to FIG. 1, FIGS. 2(*a*)-2(*f*), FIGS. 3(*a*)-3(*b*), FIGS. 4(*a*)-4(*c*), FIGS. 5(*a*)-5(*f*), and FIG. 6, but the present invention is not limited thereto.

FIG. 1 is a schematic cross-sectional diagram showing an example of a full-color image forming apparatus.

In FIG. 1, numeral 1 represents a full-color image forming apparatus, which is one called a tandem type full-color image forming apparatus. Full-color image forming apparatus 1 is equipped with plural image forming units 10Y, 10M, 10C and 10Bk, endless belt-shaped intermediate transfer member forming unit 7 as a transfer section, endless belt shaped paper supply and conveyance device 21 which conveys recording medium P, and fixing device 24 as a fixing device. Document image reading device SC is placed on top of main body A of full-color image forming apparatus 1.

As a toner image of a different color formed on each of photoreceptors 1Y, 1M, 1C and 1K, image forming unit 10Y to form an image of yellow is equipped with photoreceptor 1Y jointing a flange to a drum-shaped body possessing a photosensitive layer as the first image carrier, a charging device 2Y placed around photoreceptor 1Y, an exposure device 3Y, developing device 4Y, primary transfer roller 5Y as the primary transfer device and cleaning device 6Y.

As a toner image of another different color, image forming unit 10M to form an image of magenta is equipped with photoreceptor 1M jointing a flange to a drum-shaped body possessing a photosensitive layer as the first image carrier, charging device 2M placed around photoreceptor 1M, exposure device 3M, developing device 4M, primary transfer roller 5M as the primary transfer device and cleaning device 6M.

Further, as a toner image of another different color, image forming unit 10C to form an image of cyan is equipped with photoreceptor 1C jointing a flange to a drum-shaped body possessing a photosensitive layer as the first image carrier, charging device 2C placed around photoreceptor 1C, exposure device 3C, developing device 4C, primary transfer roller 5C as the primary transfer device and cleaning device 6C.

Furthermore, as a toner image of another different color, image forming unit 10K to form an image of black is equipped with photoreceptor 1K jointing a flange to a drum-shaped body possessing a photosensitive layer as the first image carrier, charging device 2K placed around photoreceptor 1K, exposure device 3K, developing device 4K, primary transfer roller 5K as the primary transfer device and cleaning device 6K.

The endless belt-shaped intermediate transfer member unit 7 wound by plural rollers has endless belt-shaped intermediate transfer member 70 as the second image carrier in the form of a semi-conductive endless belt which is rotatably held.

An image of each of colors formed from image forming units 10Y, 10M, 10C and 10K is successively transferred onto rotatable endless belt-shaped intermediate transfer member 70 by primary transferring rollers 5Y, 5M, 5C and 5Bk to form a synthesized color image. Recording medium P such as a paper sheet as a recording medium stored in paper supply cassette 20 is supplied by paper supply and conveyance device 21, and conveyed to secondary transfer roller 5A as the secondary transfer device through plural intermediate rollers 22A, 22B, 22C, 22D and registration roller 23 to transfer color images on recording medium P all together.

Recording medium P onto which color images are transferred is fixed by fixing device 24 fitted with heat roller fixing device 270 and nipped with paper-ejection rollers 25 to place it on paper-ejection tray 26 outside the apparatus.

After transferring color images onto recording medium P by secondary transfer roller 5A, the toner remaining on endless belt intermediate transfer member 70 obtained via self stripping of recording medium P is removed by cleaning device 6A.

Primary transfer roller 5K is constantly pressed against photoreceptor 1K during an image formation process. Each of other primary transfer rollers 5Y, 5M and 5C is pressed against each of corresponding photoreceptors 1Y, 1M and 1C, only during color image formation.

Secondary transfer roller 5A is pressed against endless belt-shaped intermediate transfer member 70, only when secondary transferring is carried out while passing through recording medium P.

Enclosure 8 is possible to be drawn out through supporting rails 82L and 82R from main body A of the apparatus. Enclosure 8 possesses image forming units 10Y, 10M, 10C and 10K, and endless belt-shaped intermediate transfer member unit 7.

Image forming units 10Y, 10M, 10C and 10K are serially placed in the perpendicular direction. Endless belt-shaped intermediate transfer unit 7 is placed on the left side of each of photoreceptors 1Y, 1M, 1C and 1K in the figure. Endless belt-shaped intermediate transfer unit 7 wound by rollers 71, 72, 73, 74 and 76 is composed of rotatable endless belt-shaped intermediate transfer member 70, primary transfer rollers 5Y, 5M, 5C and 5K, and cleaning device 6A.

Image forming units 10Y, 10M, 10C and 10K and endless belt-shaped intermediate transfer unit 7 are drawn out together by drawing enclosure 8 from main body A.

As described above, after charging the circumferential surface of each of photoreceptors 1Y, 1M, 1C and 1K to be exposed to light, and forming a latent image on the circumferential surface, each of toner images is formed via development (image visualization), and the toner images of each color are superposed on endless belt-shaped intermediate transfer member 70 to transfer them onto recording medium P all together and fix them via application of pressure and heat employing fixing device 24. In addition, "during image formation" described in the present invention means inclusion of latent image formation, and toner image (image visualization) transferred onto recording medium P to form the final image.

The toner remaining on the photoreceptor during transfer is cleaned with cleaning device 6A, and subsequently, photoreceptors 1Y, 1M, 1C and 1K after transferring the toner image onto recording medium P are moved to the above-described cycles of electrification, exposure and development to conduct the next image formation.

In the above-described color image forming apparatus, an elastic blade is utilized as a cleaning member for cleaning device 6A to clean an intermediate member. Coating devices 11Y, 11M, 11C and 11K to coat a fatty acid metal salt are provided in each of photoreceptors. In addition, the same kind as used for the toner can be used as the fatty acid metal salt.

When charging the circumferential surface of each of photoreceptors 1Y, 1M, 1C and 1K to be exposed to light, and forming a latent image on the circumferential surface, and when transferring the toner image onto recording medium P (image visualization), image reproduction of the latent image is deteriorated in the case of generation of rotation runout in rotation of photoreceptors 1Y, 1M, 1C and 1K, whereby image reproduction of the final image is deteriorated. Specifically, when each of photoreceptors 1Y, 1M, 1C and 1K produces different rotation runout, color matching is difficult to be done, whereby "out of color registration" is generated, and fine line reproduction is degraded. This is also suitable for a monochromatic image forming apparatus (not shown in the figure), and no rotation runout is demanded. Specifically, it is further preferred that a photoreceptor, in which oxytitanium phthalocyanine having a maximum diffraction peak at a Bragg angle ($2\theta \pm 0.2°$) of 27.2° in CuKα X-ray diffraction is used, exhibits extremely high sensitivity. The present invention relates to a photoreceptor in which oxytitanium phthalocyanine having a maximum diffraction peak at a Bragg angle ($2\theta \pm 0.2°$) of 27.2° in CuKα X-ray diffraction is used, exhibiting minimized rotation runout during image formation.

Each of FIGS. 2(*a*)-2(*f*) is a schematic cross-sectional view showing an example of a layer structure of a body possessing a photosensitive layer (hereinafter, also referred to simply as a photoreceptor).

Any of these cases of the layer structure may be employed for the photoreceptor of the present invention, but a function-separation type photoreceptor as a multilayer type or a dispersion type is preferable. In this case, layer structures as shown in FIGS. 2(*a*)-2(*f*) are conventionally employed.

Figure 2:
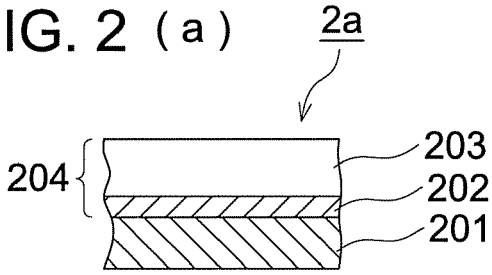
Figure 2:
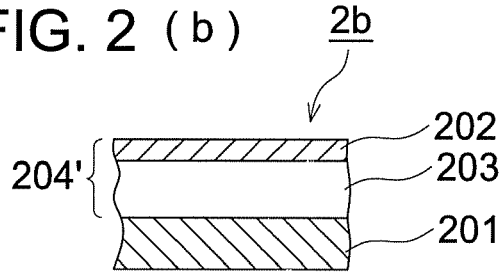
Figure 2:
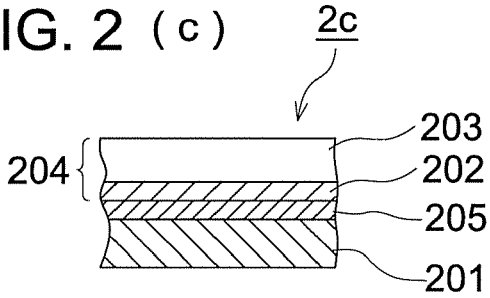
Figure 2:
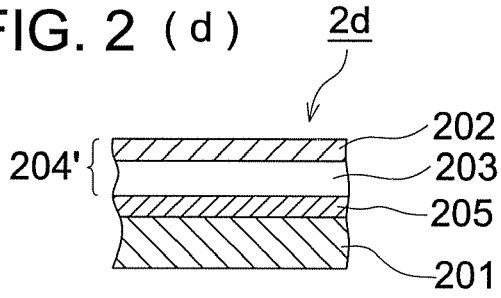
Figure 2:
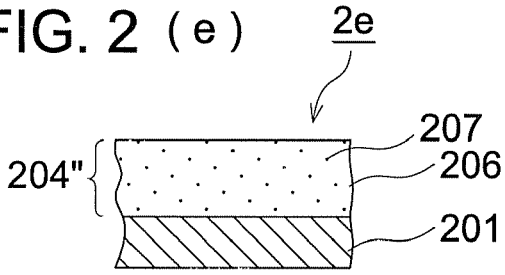
Figure 2:
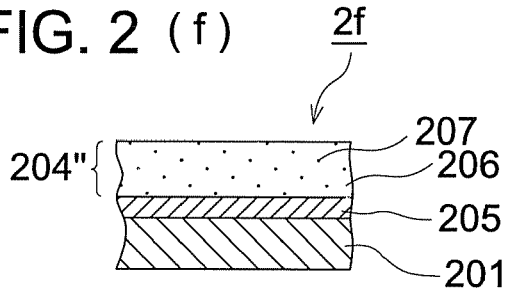

FIG. 2(*a*) will be described. In the figure, numeral 2*a* represents a photoreceptor. In photoreceptor 2*a*, charge generation layer 202 is formed on the circumferential surface of conductive support 201, and charge transport layer 203 is layered thereon to form photosensitive layer 204.

FIG. 2(*b*) will be described. In the figure, numeral 2*b* represents a photoreceptor. In the case of photoreceptor 2*b*, photosensitive layer 204', in which charge generation layer 202 and charge transport layer 203 shown in FIG. 2(*a*) are reversely placed, is formed.

FIG. 2(*c*) will be described. In the figure, numeral 2*c* represents a photoreceptor. In photoreceptor 2*c*, intermediate layer 205 is formed on the circumferential surface of conductive support 201, charge generation layer 202 is formed thereon, and charge transport layer 203 is further layered thereon to form photosensitive layer 204.

FIG. 2(*d*) will be described. In the figure, numeral 2*d* represents a photoreceptor. In photoreceptor 2*d*, intermediate layer 205 is formed on the circumferential surface of conductive support 201, charge transport layer 203 is formed thereon, and charge generation layer 202 is further layered thereon to form photosensitive layer 204'.

FIG. 2(*e*) will be described. In the figure, numeral 2*e* represents a photoreceptor. In photoreceptor 2*e*, photosensitive layer 204" containing charge generation material 206 and charge transport material 207 is formed on the circumferential surface of conductive support 201.

FIG. 2(*f*) will be described. In the figure, numeral 2*f* represents a photoreceptor. In photoreceptor 2*f*, intermediate layer 205 is formed on the circumferential surface of conductive support 201, and photosensitive layer 204" containing charge generation material 206 and charge transport material 207 is formed thereon.

The structure of the photoreceptor employed in the present invention may be any of those shown in FIGS. 2(*a*)-2(*f*), but a protective layer can be formed as the outermost layer. These photoreceptors are usable for a full-color image forming apparatus as well as a monochromatic image forming apparatus.

An oxytitanium phthalocyanine pigment as charge generation material (CGM) is contained in charge generation layer 202 shown in the present figure. As the oxytitanium phthalocyanine pigment, utilized is an oxytitanium phthalocyanine pigment having a maximum peak at a Bragg angle (2θ±0.2°) of 27.2° in a CuKα X-ray diffraction spectrum.

Figure 3:
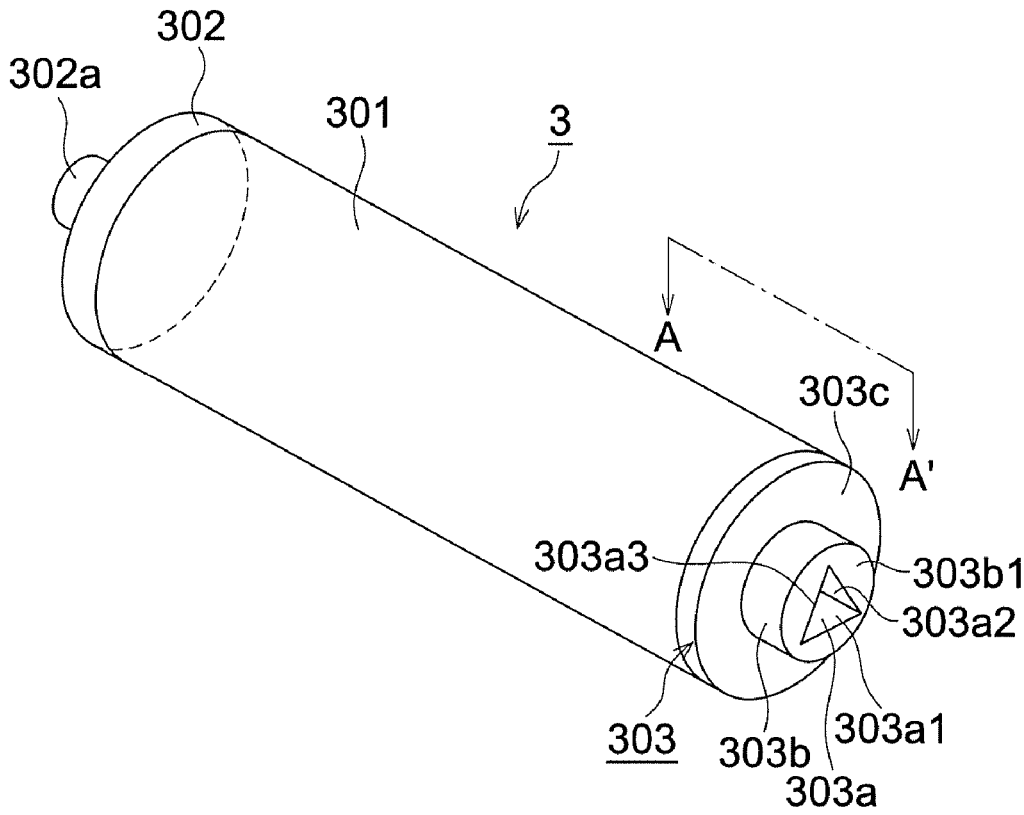
FIG. 3(*a*) is a schematic perspective view of the electrophotographic photoreceptor of the present invention.
Figure 3:
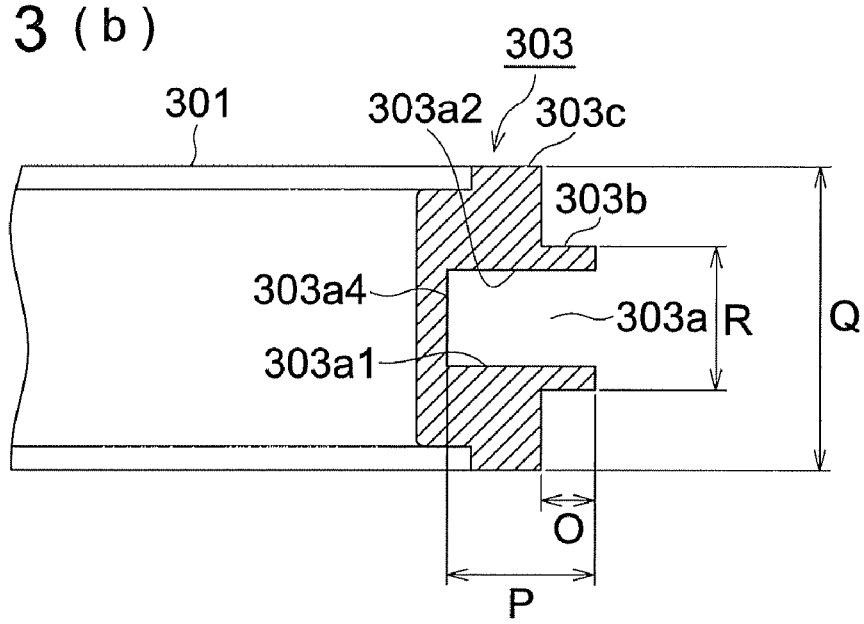

FIGS. 3(*a*) and 3(*b*) each is a schematic diagram of a photoreceptor. FIG. 3(*a*) is a schematic perspective view of the photoreceptor, and FIG. 3(*b*) is a schematic cross-sectional view along A-A' in FIG. 3(*a*).

In FIG. 3(*a*), numeral 3 represents an electrophotographic photoreceptor. Electrophotographic photoreceptor 3 possesses body 301 fitted with a photosensitive layer, flange 302 at one end of body 301, and flange 303 at another end of body 301. These flanges are jointed at both ends of body 301. When flange 302 is set to image forming apparatus 1 (refer to FIG. 1), it possesses a sliding shaft (not shown in the figure) to maintain rotation of electrophotographic photoreceptor 3.

Flange 303 with substrate 303*c* is engaged with a rotation shaft on the side of image forming apparatus 1 (refer to FIG. 1) when setting it to image forming apparatus 1, and has driving shaft 303*b* with drive hole 303*a* having at least 3 sides in order to rotate electrophotographic photoreceptor 3. In the present figure, drive hole 303*a* has 3 sides, but as the upper limit it has 8 sides.

Numeral 303*b*1 represents the surface to produce drive hole 303*a*. In the present figure, driving shaft 303*b* provided only on one side is shown, but the driving shaft provided at both ends is allowed to be placed. The shape of drive hole 303*a* has at least 3 sides. Numerals 303*a*1, 303*a*2 and 303*a*3 each represent an inside surface of drive hole 303*a*, and numeral 303*a*4 represents the bottom surface of drive hole 303*a*.

Symbol O represents the length of driving shaft 303*b*. A length O of 2-40 mm is preferable in view of depth of the drive hole, rotation stability of an electrophotographic photoreceptor, the entire length of an electrophotographic photoreceptor, downsizing of an image forming apparatus and so forth.

Symbol P represents the depth of drive hole 303*a*. A depth P of 4-60 mm is preferable in view of rotation stability of an electrophotographic photoreceptor, flange strength resistance and so forth.

Symbol Q represents the diameter of flange 303. Diameter Q can not be clearly specified depending on desired size of an electrophotographic photoreceptor.

Symbol R represents the diameter of driving shaft 303*b*. Diameter R is preferably 15-100% with respect to diameter Q of flange 303 in view of strength of a driving shaft, rotation stability of a photoreceptor, downsizing of an image forming apparatus and so forth.

Each of the flanges has a drive hole 303*a* cross-sectional area of 20-90%, based on a surface area of a surface to provide driving shaft 303*b* in view of strength of a driving shaft, rotation stability of an electrophotographic photoreceptor, load to engaging parts in an image forming apparatus, and so forth.

Figure 4:
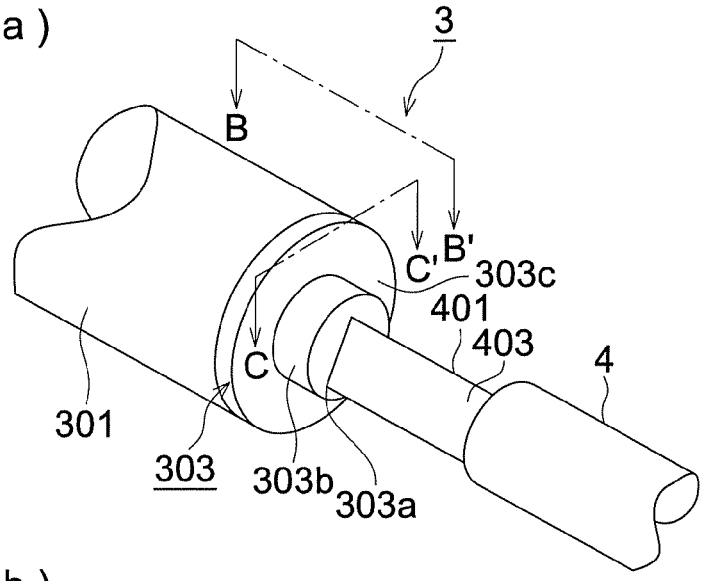
Figure 4:
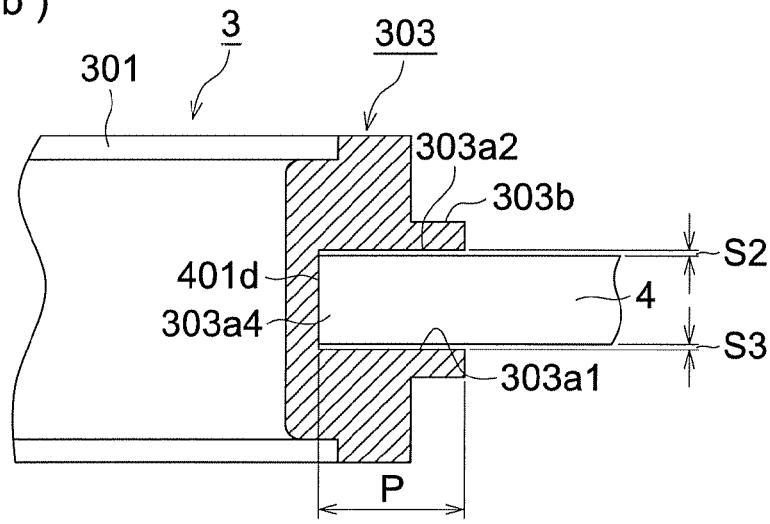
Figure 4:
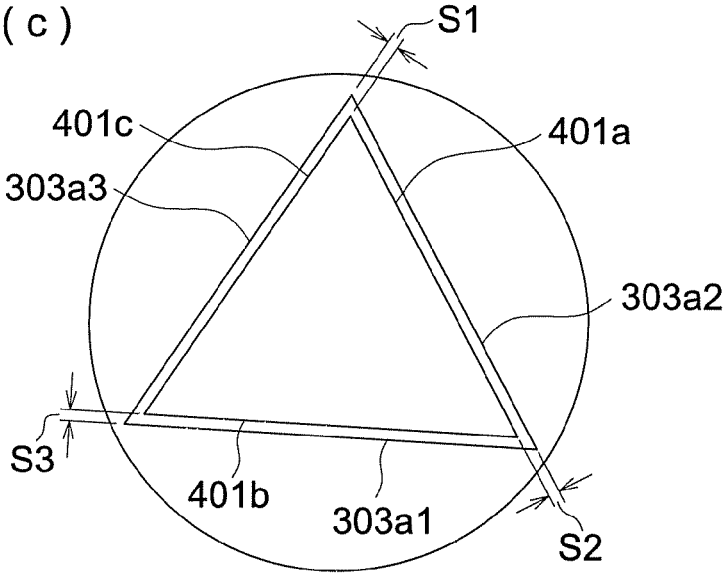

Each of FIGS. 4(*a*)-4(*c*) is a partial schematic diagram showing a situation where a drive hole formed in a driving shaft of the electrophotographic photoreceptor shown in FIGS. 3(*a*) and 3(*b*) is engaged with a rotation shaft of an image forming apparatus. FIG. 4(*a*) is a partial schematic perspective view showing a situation where a drive hole formed in a driving shaft of the photoreceptor shown in FIGS. 3(*a*) and 3(*b*) is engaged with a rotation shaft of an image forming apparatus. FIG. 4(*b*) is a partial schematic enlarged cross-sectional view along B-B' of FIG. 4(*a*). FIG. 4(*c*) is a schematic enlarged cross-sectional view along C-C' of FIG. 4(*a*). In addition, FIG. 4(*c*) shows a cross-sectional view in the direction perpendicular to the shaft center of the electrophotographic photoreceptor.

In FIG. 4(*a*), numeral 4 represents a rotation shaft of image forming apparatus 1 (refer to FIG. 1), and numeral 401 represents a engaging part. Engaging part 401 is formed from a triangle pole having surface 401*a*, surface 401*b* and surface 401*c*, and coincides with drive hole 303*a* in shape.

Numeral 401*d* represents the bottom surface of engaging part 401. When engaging part 401 is engaged with drive hole 303*a*, bottom surface 303*a*4 of drive hole 303*a* is preferably in contact with bottom surface 401*d* of engaging part 401 in view of rotation runout of electrophotographic photoreceptor 3 and load of rotation shaft 4.

Numeral S1 represents a spacing between inside surface 303*a*3 of drive hole 303*a* and surface 401*c* of engaging part 401. Numeral S2 represents a spacing between inside surface 303*a*2 of drive hole 303*a* and surface 401*a* of engaging part 401. Numeral S3 represents a spacing between inside surface 303*a*1 of drive hole 303*a* and surface 401*b* of engaging part 401. In addition, the spacing between each of inside surfaces 303*a*1-303*a*3 of drive hole 303*a* and each of corresponding surfaces 401*a*-401*c* of engaging part 401 has been described, but the case of only spacing S1, only spacing S2 or only spacing S3 is employed depending on the engaging situation.

The relationship in the case of engagement of engaging part 401 with drive hole 303*a* will be described in FIG. 4(*c*). In the present invention, a ratio B/A of a cross-sectional area B of an engaging part of a rotation shaft to rotate an electrophotographic photoreceptor with respect to another cross-sectional area A of a drive hole is 0.890-0.998. In the case of a ratio B/A of less than 0.890, the spacing between the drive hole and the rotation shaft becomes large, and rotation runout accuracy of the photoreceptor is degraded, whereby image quality is undesirably lowered. In the case of a ratio B/A exceeding 0.998, the rotation shaft is difficult to be inserted into the drive hole. Further, since rotation of the rotation shaft falls outside from an ideal situation in view of both the shaft position and the rotation speed because of slight existence of runout accuracy in rotation of the rotation shaft which is not zero and presence of slight rotation unevenness of the rotation shaft, this directly influences the photoreceptor though drive hole 303*a* of the flange, whereby rotation runout accuracy of the photoreceptor is rather deteriorated. The ratio B/A exceeding 0.998 is not preferable for this reason.

Figure 5:
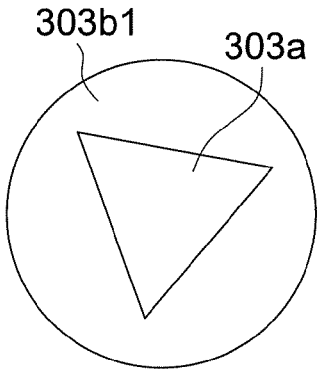
Figure 5:
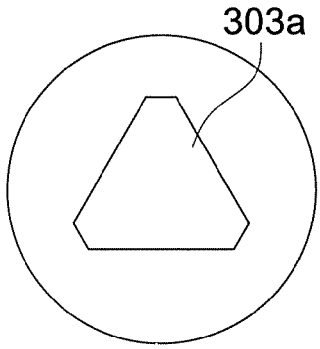
Figure 5:
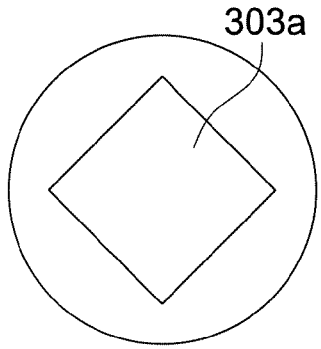
Figure 5:
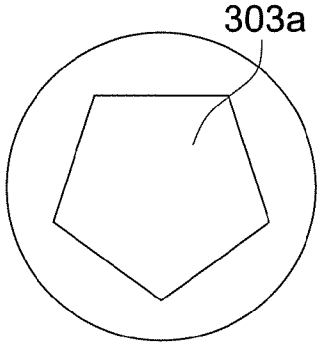
Figure 5:
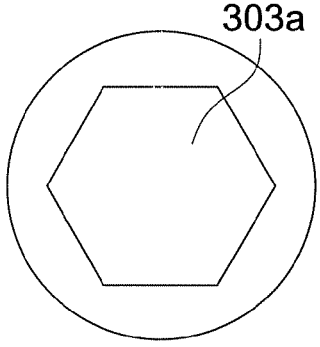
Figure 5:
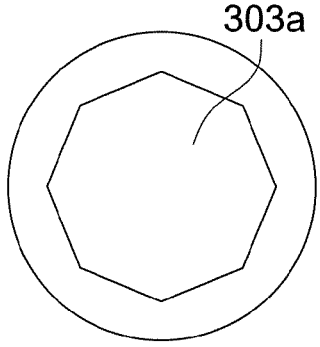

The relationship between the cross-sectional area of engaging part 401 and the cross-sectional area of drive hole 303*a* is also identical to those with respect to all drive holes shown in FIGS. 5(*a*)-5(*f*).

In recent years, high speed and fine definition sharpness of an image have been demanded. A dot diameter at a time when an image is written in a photoreceptor is desired to be decreased for the fine definition sharpness of an image, which is easily influenced by rotation runout of the photoreceptor via decreasing of the dot diameter. In order to increase the high speed, not only a photoreceptor possessing a photosensitive layer containing an oxytitanium phthalocyanine pigment having a maximum diffraction peak at a Bragg angle (2θ±0.2°) of 27.2° in CuKα X-ray diffraction should be utilized, but also rotation speed should be increased. There is a problem caused by increasing a rotation speed of the photoreceptor such that the effect of decreasing a dot diameter for fine definition sharpness of the image can not be produced since rotation runout of the photoreceptor becomes large. In order to solve this problem, it is effective to utilize an electrophotographic photoreceptor of the present invention.

That is, an electrophotographic photoreceptor of the present invention equipped with a flange with a drive hole having at least 3 sides, having a ratio of the cross-sectional area of the drive hole as described above to the engaging part of the rotation shaft is used for a so-called high-speed image forming apparatus fitted with the photoreceptor with a rotation rate of 70-150 rpm, and the relationship expressed by the following inequality (1) is preferably satisfied in order to obtain images of fine definition sharpness in view of "out of color registration", image reproduction, fine line reproduction and so forth between dot diameter P of image write of an image forming apparatus and rotation runout accuracy F of the electrophotographic photoreceptor.

$$F/P<0.50 \qquad \text{Inequality (1)}$$

The lower limit of F/P is preferably 0.05. Even though the value of F/P becomes smaller than 0.05, no further improvement of the image can be expected, and the manufacturing difficulty level becomes high in view of high-precision material and processing. Rotation runout accuracy F of the electrophotographic photoreceptor is determined by the following method.

Employing a digital dimension measuring device manufactured by Keyence Corporation (sensor head: EX-305V type, amplifier unit: EX-V01 type), a sensor is set 0.5 mm away facing a photoreceptor in an image forming apparatus, and the maximum value of displacement is recorded by rotating the photoreceptor 10 revolutions to designate the resulting value as a value of runout.

Each of FIGS. 5(*a*)-5(*f*) is a schematic elevation diagram showing shape of the drive hole shown in FIGS. 3(*a*) and 3(*b*).

FIG. 5(*a*) shows the shape of a regular triangle having 3 sides. FIG. 5(*b*) shows shape composed of 6 sides. FIG. 5(*c*) shows the shape of a regular tetragon having 4 sides. FIG. 5(*d*) shows the shape of a regular pentagon having 5 sides. FIG. 5(*e*) shows the shape of a regular hexagon having 6 sides. FIG. 5(*f*) shows the shape of a regular octagon having 8 sides. Features of shapes of drive hole 303*a* shown in FIGS. 5(*a*)-5(*f*) will be described referring to these figures.

The rotary drive force of the rotation shaft from the image forming apparatus is received on each surface via dispersion of the power by employing a drive hole having 3-8 surfaces as shown in the present figure, and evenly transmitted to the drive hole, whereby the rotation is stabilized to reduce runout thereof. Further, since the rotary drive force is not concentrated, use for a long duration is withstood, and stable rotation can be conducted for a longer time of operation.

Figure 6:
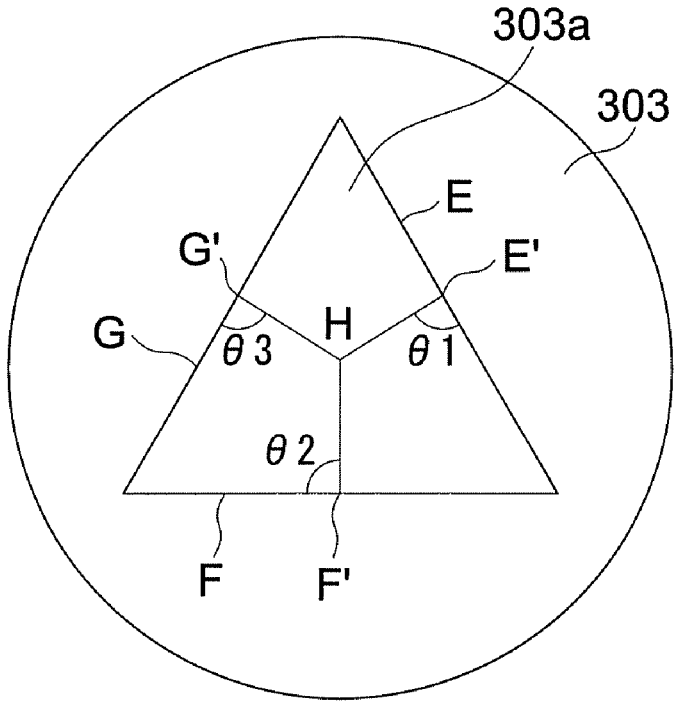
FIG. 6 shows schematic enlarged elevation diagrams showing shape features of the drive hole shown in FIG. 5(*a*).
Figure 6:
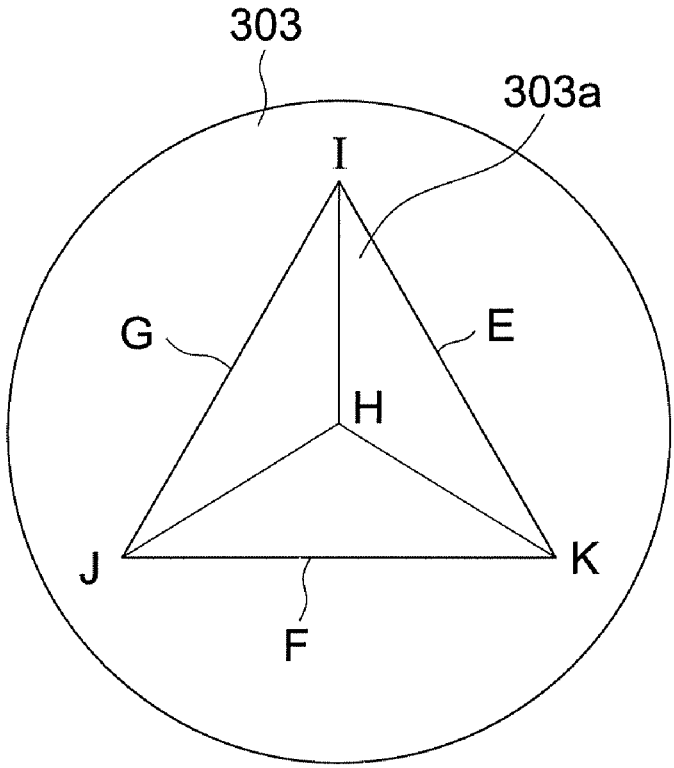

FIG. 6 shows schematic enlarged elevation diagrams showing shape features of the drive hole shown in FIG. 5(*a*).

The shape of the drive hole has the following features.

(1) In the figure, symbols E, F and G represent each side constituting drive hole 303*a*. Symbol H represents a center point of drive hole 303*a*. The center point in the present invention means a gravity center of the graphic form {a regular triangle in the case of FIG. 5(*a*)} formed on the surface to provide drive hole 303*a*. Symbol E' represents the midpoint of side E. Symbol F' represents the midpoint of side F. Symbol G' represents the midpoint of side G. As shown in FIG. 6, symbol θ1 represents an angle formed from a line connecting midpoint E' with center point H and side E, symbol θ2 represents an angle formed from a line connecting midpoint F' with center point H and side E, and symbol θ3 represents an angle formed from a line connecting midpoint G' with center point H and side G. Any of θ1, θ2 and θ3 is 90°.

(2) In the figure, symbols I, J and K represent each apex of drive hole 303*a*. The shape of the region surrounded with a line connecting apex I with center point H, a line connecting apex J with center point H, and side G is an isosceles angle. The shape of the region surrounded with a line connecting apex I with center point H, a line connecting apex K with center point H, and side E is an isosceles angle. The shape of the region surrounded with a line connecting apex I with center point H, a line connecting apex J with center point H, and side G is an isosceles angle.

(3) Center point H of drive hole 303*a* is identical to the center point of flange 303. Herein, the center point of flange 303 means a center of the circle formed when cutting in the cross-section in the direction perpendicular to the photoreceptor shaft as an engaging part of the flange with the photoreceptor.

Drive hole 303*a* shown in each of other FIG. 5(*b*)-5(*f*) also has features shown in the above-described (1) and (2).

Materials contained in flange 303 shown in FIGS. 3(*a*)-3(*b*), FIGS. 4(*a*)-4(*c*), FIGS. 5(*a*)-5(*f*), and FIG. 6 are not specifically limited, and examples thereof include metal such as aluminum or the like, and thermoplastic resins such as polycarbonate (PC), polyacetal (polyoxymethylene POM), polybutylene terephthalate (PBT), polyethylene terephthalate (PET), polysulfon (PSU), polystyrene (PS), polypropylene (PP) and so forth. In cases where a resin is used as a flange material, it is possible to add various fillers, if desired. In the case of aluminum, it can be manufactured via casting and molding, and a cutting process or the like can also be conducted, if desired, in order to obtain dimensional accuracy. In the case of the thermoplastic resins, a conventional injection molding is used for manufacturing.

An electrophotographic photoreceptor of the present invention, shown in FIGS. 2(*a*)-2(*f*), FIGS. 3(*a*)-3(*b*), FIGS. 4(*a*)-4(*c*), FIGS. 5(*a*) 5(*f*), and FIG. 6, produces the following effects.

(1) The rotary drive force of the rotation shaft from the image forming apparatus is received on each surface via dispersion of the power, and evenly transmitted to the drive hole, whereby the rotation is stabilized to minimize runout thereof. Thus, image reproduction and fine line reproduction are improved.

(2) Since rotation of the photoreceptor is stabilized to minimize runout, image reproduction and fine line reproduction are improved without reducing the number of rotations, and high speed becomes possible, even though an oxytitanium phthalocyanine pigment having a maximum diffraction peak at a Bragg angle (2θ±0.2°) of 27.2° in CuKα X-ray diffraction is employed.

(3) Since the rotary drive force of the rotation shaft from the image forming apparatus is received on each surface via dispersion of the power, inhibited can be mechanical degradation of a drive hole of a flange, cracks of a rotation shaft, deformation or the like in cases where load at the portion to which the rotary drive force of the rotation shaft and the drive hole is transmitted is reduced, and the photoreceptor is used for a long duration, whereby image evenness and images exhibiting excellent fine line reproduction are possible to be obtained for a long duration.

Next, an electrophotographic photoreceptor having a layer structure in which an intermediate layer is provided on the circumference of a conductive support, and a charge generation layer, a charge transfer layer and a protective layer containing a filler are also provided thereon will be described as an example of the photoreceptor of the present invention.

(Conductive Support)

The support of the present invention is cylindrical, and preferably has a specific resistance of $10^3$ Ωcm or less. As a specific example, an aluminum cylinder subjected to washing the surface after a cutting process can be provided.

(Intermediate Layer)

An intermediate layer formation coating solution composed of a binder, a dispersion solvent and so forth is coated on a conductive support, and dried to form an intermediate layer. As the binder for the intermediate layer, a polyamide resin, a vinyl chloride resin, a vinyl acetate resin and a copolymer resin containing at least two repeating units of the above resin are usable. Of these resins, the polyamide resin is preferable since increase of a residual potential via repetitive use can be minimized. Further, additives such as a filler of titanium oxide, zinc oxide or the like, a antioxidant and so forth can be added into an intermediate layer, if desired, in order to improve electrical potential characteristics, and to reduce defects of black spots, moire and so forth.

As the solvent to prepare an intermediate layer formation coating solution, preferable is a solvent in which inorganic particles added, if desired, are well-dispersed, and a polyamide resin is dissolved. Specifically, alcohols having 2-4 carbon atoms such as methanol, ethanol, n-propyl alcohol, isopropyl alcohol, n-butanol, t-butanol and sec-butanol are preferable are preferable in view of excellent solubility and coatability of the polyamide resin. The above-described solvent has a content of 30-100% by weight, preferably has a content of 40-100% by weight, and more preferably has a content of 50-100% by weight, based on the weight of the entire solvent. Examples of the auxiliary solvent used in combination with the foregoing solvent, which produces preferable effects include benzyl alcohol, toluene, methylene chloride, cyclohexanone, tetrahydrofuran and so forth. The intermediate layer preferably has a layer thickness of 0.2-40 μm, and more preferably has a layer thickness of 0.3-20 μm.

(Photosensitive Layer)

The photosensitive layer may be one having a single layer structure exhibiting charge generation and charge transport functions, but is preferably one having a separate layer structure in which charge generation layer (CGL) and charge transport layer (CTL) each exhibiting a function of the photosensitive layer are separately provided. Increase in residual potential via repetitive use can be controlled to be minimized by taking the separate function layer structure, whereby other electrophotographic properties are easy to be controlled in line with the purpose. In the case of a photoreceptor for negative electrification, charge generation layer (CGL) is provided on an intermediate layer, and charge transport layer (CTL) is provided thereon. In the case of a photoreceptor for positive electrification, the charge generation layer and the charge transport layer are arranged to be reversely placed. The preferable layer structure of the photoreceptor is of the case where a photoreceptor for negative electrification has the foregoing separate function layer structure.

Each layer of the photosensitive layer employed for a photoreceptor for negative electrification having the separate function layer structure will be described below.

<Charge Generation Layer (CGL)>

CGL contains charge generation material (CGM). A binder resin and additives as other materials may optionally be contained in the charge generation layer. As CGM, utilized is an oxytitanium phthalocyanine pigment having a maximum peak at a Bragg angle (2θ±0.2°) of 27.2° in a CuKα X-ray diffraction spectrum, which is commonly known.

When a binder is used as a dispersing medium for CGM in CGL, commonly known binders are usable, but examples of the most preferable resin include a formal resin, a butyral resin, a silicone resin, a silicone-modified butyral resin and a phenoxy resin. A ratio of CGM to the binder resin is preferably 20-600 parts by weight of CGM per 100 parts of the binder resin. The increase in residual potential via repetitive use can be minimized by using such the resin. CGL preferably has a layer thickness of 0.01-2.00 μm.

<Charge Transport Layer (CTL)>

CTL is formed from a filler, CTM and a binder resin, in cases where CTL is provided as a surface layer. Additives such as an antioxidant and so forth may be added into CTL as the other material. CTL preferably has a layer thickness of 5-40 μm, and more preferably has a layer thickness of 10-30 μm. When forming a surface layer as CTL, an amount of the filler occupied in CTL is preferably 5-50% by weight. As CTM, commonly known CTM is usable, and examples thereof include a triphenylamine derivative, a hydrazone compound, a styryl compound, a benzidine compound, a butadiene compound and so forth.

Examples of the resin employed for CTL include polystyrene, an acrylic resin, a methacrylic resin, a vinylchloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer resin containing at least two repeating units of the above-described resins. An organic polymer semiconductor such as poly-N-vinylcarbazole and so forth, other than insulating resins of these is applicable.

The polycarbonate resin is most preferable as a binder for CTL. The polycarbonate resin is most preferable in view of excellent dispersibility of CTM and an excellent electrophotographic property. The ratio of the charge transport material to the binder is preferably 10-200 parts by weight of CTM per 100 parts by weight of the binder resin. In addition, the charge transport layer preferably has a layer thickness of 10-40 μm.

A commonly known compound is usable as an antioxidant, and specifically, "Irganox 1010" produced by Nihon Ciba-Geigy K.K. can be provided.

(Protective Layer)

A protective layer can be provided in a photoreceptor of the present invention, if desired. The protective layers having various compositions can be utilized. For example, preferable is one formed by adding a filler containing a resin exhibiting wear resistance, inorganic particles made of silica, alumina or the like, organic particles made of PTFE, acryl or the like onto a surface layer. Examples of resins used for the protective layer include a polycarbonate resin, an acrylic resin, a phenol resin, an epoxy resin, a urethane resin, a siloxane resin and so forth. In cases where the surface layer is formed for the protective layer, an amount of the filler occupied in the protective layer is preferably 5-50% by weight.

Each of an intermediate layer, a photosensitive layer, a charge generation layer, a charge transport layer and a protective layer fitted into a photoreceptor can be produced by forming a layer by an immersion coating method, a circular coating amount control type coating method, or the immersion coating method and the circular coating amount control type coating method in combination, but the coating method is not limited thereto. In addition, the circular coating amount control type coating method is detailed in Japanese Patent O.P.I. Publication No. 58-189061.

Each color developer employed when a photoreceptor of the present invention is employed to form an image is usable as a single-component developer or a two-component developer. Of these, a two-component developer exhibiting high durability, and a two-component developer employing a ferrite carrier subjected to a coating treatment on the surface.

The two-component developer is preferably heat-fixable, and is composed of small particles having a volume-based median diameter ($D_{50}$) of 3.0-8.0 μm. Specific examples of the resin constituting the toner include a polyester resin and an acrylic resin. A method of manufacturing the toner is not specifically limited, and the toner prepared by a commonly known polymerization method or crushing method is utilized, but preferable is one prepared by adding external additives into particles prepared via a polymerization method by which evenly shaped toner having a small particle diameter is easy to be obtained.

A fatty acid metal salt is preferably used as external additives, and the fatty acid metal salt is preferably a metal salt of a saturated or unsaturated fatty acid having at least 10 carbon atoms. Examples thereof include aluminum stearate, indium stearate, gallium stearate, zinc stearate, lithium stearate, magnesium stearate, sodium stearate, aluminum palmitate, aluminum oleate and so forth. Of these, the stearic acid metal salt is more preferable.

In the case of the fatty acid metal salt, the fatty acid metal salt is preferably dispersed in the toner via an aftertreatment process while mixing and stirring. The addition amount is preferably 0.01-1% by weight based on the toner, depending on a particle diameter of the toner.

The frictional force with an intermediate transfer member is preferably stabilized by utilizing the toner prepared via addition of the fatty acid metal salt as external additives.

The foregoing ferrite carrier preferably has a volume average particle diameter of 15-100 μm, and more preferably has a volume average particle diameter of 25-80 μm.

The volume average particle diameter of the carrier can be measured employing a laser diffraction type particle size distribution measuring apparatus equipped with a wet disperser, HELOS (produced by SYMPATEC Corp.) as a typical one.

EXAMPLE

Next, the present invention will now be described in detail referring to examples, but embodiments in the present invention are not limited thereto. Incidentally, "parts" in the description represents "parts by weight".

Example 1

Preparation of Conductive Support

A cylindrical aluminum conductive support having a thickness of 2 mm, a diameter of 99.66 mm and a length of 360 mm was arranged to be prepared.

(Preparation of Flange Fitted with Driving Shaft)

An aluminum flange in which a polygonal drive hole shown in Table 1 was formed in the center of a driving shaft as shown in FIGS. 3(*a*) and 3(*b*) was arranged, and designated as No. a-No. f.

| | |
|---|---|
| Substrate diameter | 99.66 mm |
| Driving shaft length | 20 mm |
| Driving shaft diameter | 20 mm |
| Drive hole depth | 16 mm |

Opening area of the drive hole 8 (A ratio of the driving shaft to the surface to form the drive hole) 60%

TABLE 1

| Flange No. | Shape of drive hole |
|---|---|
| a | Shape shown in FIG. 5(a) |
| b | Shape shown in FIG. 5(b) |
| c | Shape shown in FIG. 5(c) |
| d | Shape shown in FIG. 5(d) |
| e | Shape shown in FIG. 5(e) |
| f | Shape shown in FIG. 5(f) |

(Preparation of Flange Fitted with Sliding Shaft)

An aluminum flange having a substrate diameter of 99.66 mm and a sliding shaft length of 25 mm was arranged to be prepared.

(Preparation of Photoreceptor)

An intermediate layer, a charge generation layer and a charge transport layer were laminated on the prepared conductive support in order by the following method, and the photoreceptor bodies shown in Table 2 were designated as Nos. 1-1-1-6.

| (Formation of intermediate layer) | |
|---|---|
| Polyamide resin CM8000 (produced by Toray Industries, Inc.) | 1 part |
| Titanium dioxide SMT500SAS (produced by Tayca Corporation) | 3 parts |
| Methanol | 10 parts |

After dispersing the admixture containing the above-described components, the resulting was immersion-coated on the prepared aluminum substrate, and dried to form an intermediate layer having a thickness of 1.5 μm.

| (Formation of charge generation layer) | |
|---|---|
| Butyral resin (BH-1, produced by Sekisui Co., Ltd.) | 1.0 part |
| Acetic acid t-butyl | 88.0 parts |
| Methoxymethyl pentane | 13.0 parts |
| Oxytitanium phthalocyanine pigment exhibiting a maximum diffraction peak at a Bragg angle (2θ ± 0.2°) of 27.2° in CuKα X-ray diffraction | 2.0 parts |

The above-described components were mixed and dispersed with a sand grinder to obtain a dispersion. The dispersion was immersion-coated on an aluminum substrate on which an intermediate layer was coated, and dried to form a charge generation layer having a thickness of 0.3 μm.

{Preparation of Oxytitanium Phthalocyanine Pigment Having Maximum Diffraction Peak at a Bragg Angle (2θ±0.2°) of in CuKα X-Ray Diffraction}

A base material of a chlorine-free titanyl phthalocyanine pigment was prepared from diiminoisoindoline and titanium tetrabutoxide in accordance with Japanese Patent O.P.I. Publication No. 3-35245. At not more than 5° C., 20 g of the base material of a titanyl phthalocyanine pigment was dissolved in 200 ml of sulfuric acid, and the resulting was charged in 5.0 liter of water at 25° C. in 30 minutes. Heat was generated at first, and the final water temperature was 35° C. A precipitate was filtrated while stirring at the same temperature for one hour, and repeatedly washed with water until the filtrate reached an electrical conductivity of 20 μS/cm to obtain a wet paste of an amorphous (to be exact, B type having a low crystallinity degree) oxytitanium phthalocyanine pigment.

The resulting was added into a mixed solution of 200 ml of o-dichlorbenzene and 100 ml of water while stirring for 6 hours at 70° C. Subsequently, a large amount of methanol was added into it, and the resulting crystals was filtrated to obtain an oxytitanium phthalocyanine pigment. The resulting oxytitanium phthalocyanine pigment exhibited a Bragg angle (2θ±0.2°) of 27.2° in CuKα X-ray diffraction.

| <Charge transport layer> | |
|---|---|
| Polycarbonate resin (bisphenol Z300, produced by Mitsubishi Gas Chemicals, Inc.) | 1 part |
| Charge transport material (the following compound A) | 0.65 parts |
| Tetrahydrofran | 8 parts |
| Toluene | 2 parts |
| Silicone oil (KF-54, produced by Shin-Etsu Chemical Co., Ltd.) | 0.0001 Parts |

The above-described components were mixed to obtain an admixture for a charge transport layer. The admixture for a charge transport layer was immersion-coated on the aluminum conductive support having the above-described charge generation layer thereon, and dried at 115° C. for 70 minutes to form a charge transport layer having a layer thickness of 24 μm, whereby the photoreceptor body was obtained.

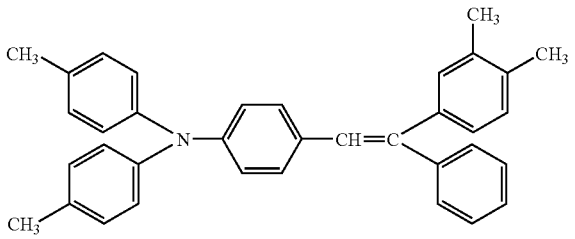

Each of flanges No. a-No. f having a prepared driving shaft and a flange having a sliding shaft were jointed to a body of the resulting photoreceptor to obtain each of electrophotographic photoreceptors No. 1-1 and No. 1-6.

TABLE 2

| Electrophotographic photoreceptor No. | Flange No. |
|---|---|
| 1-1 | a |
| 1-2 | b |
| 1-3 | c |
| 1-4 | d |
| 1-5 | e |
| 1-6 | f |

(Preparation of Image Forming Apparatus)

The engaging part of the rotation shaft at an attachment portion of each of prepared photoreceptors in a modified machine of a copying machine bizhub PRO920 manufactured by Konica Minolta Technologies, Inc. was matched to the shape of the drive hole of each of the resulting photoreceptors No. 1-1-1-6, and the ratio of the cross-sectional area of the drive hole to the cross-sectional area of the engaging part was changed as shown in Table 3 to designate image forming apparatuses fitted with the resulting photoreceptors No. 1-1-1-6 as No. 101-No. 130.

Image-writing dot diameter P is 42 μm. The number of rotation of the photoreceptor during image-writing was set to 88 rpm. In Table 3, the area ratio means a ratio B/A of a cross-sectional area B of an engaging part of a rotation shaft to rotate an electrophotographic photoreceptor with respect to another cross-sectional area A of a drive hole.

Evaluation

Rotation runout accuracy F, rotation runout accuracy F is divided by image-writing dot diameter P (F/P), evenness of halftone image and fine line reproduction of the photoreceptor of each of prepared image forming apparatuses No. 101-130 are evaluated by the methods described below, and results obtained via evaluation in accordance with the following evaluation ranks are shown in Table 3.

Measuring Method of Rotation Runout Accuracy F

Employing a digital dimension measuring device manufactured by Keyence Corporation (sensor head: EX-305V type, amplifier unit: EX-V01 type), the sensor is 0.5 mm away facing the photoreceptor in the image forming apparatus (modified machine of copying machine bizhub PRO920), sensors are placed at 3 portions such as the center position in the shaft direction, and both positions being 100 mm away from the center position in the shaft direction, and the maximum value of displacement measured by each sensor is recorded by rotating the photoreceptor 10 revolutions to designate the arithmetic mean value obtained from the resulting 3 values as a value of runout.

Evaluation Method of Evenness of Halftone Image

A halftone image having an image ratio of 25% is printed on an A4 paper sheet, the density measurement is conducted randomly at 50 portions on the halftone image of a piece of the resulting paper to obtain difference D between the maximum value and the minimum value, and evaluate evenness of halftone image. Reflection density is measured based on reference density by superposing 3 paper sheets which have been used, employing an RD-918 type densitometer (produced by Macbeth Co.).

Evaluation Ranks of Evenness of Halftone Image

A: D<0.03 Even halftone image can be obtained.

B: 0.03□ D<0.06 Slight density unevenness is observed, but almost even halftone image can be obtained.

C: 0.06□ D<0.1 Density unevenness is observed, but practically available halftone image can be obtained.

D: 0.1□ D No density unevenness of a halftone image is practically available.

Evaluation Method of Fine Line Reproduction

Line images in the shaft direction of the photoreceptor with 1 dot ON and 1 dot OFF were printed on a paper sheet, and the resulting image was visually observed to evaluate a fine line image.

Evaluation Ranks of Fine Line Reproduction

A: Fine lines are evenly reproduced.

B: Slightly disordered fine lines are observed, but most of fine lines are evenly reproduced.

C: Disordered fine lines are observed, but fine lines are practically available.

D: Disordered fine lines are largely observed, and no fine line is practically available.

TABLE 3

| Image forming apparatus No. | Area ratio (B/A) | Electrophotographic photoreceptor No. | Rotation runout accuracy F (μm) | F/P | Evenness of halftone image | Fine line reproduction | Remarks |
|---|---|---|---|---|---|---|---|
| 101 | 0.886 | 1-1 | 51 | 1.21 | D | D | Comp. |
| 102 | 0.891 | 1-1 | 31 | 0.74 | B | B | Inv. |
| 103 | 0.940 | 1-1 | 23 | 0.55 | B | B | Inv. |
| 104 | 0.998 | 1-1 | 27 | 0.64 | B | B | Inv. |
| 105 | 0.999 | 1-1 | 49 | 1.17 | D | D | Comp. |
| 106 | 0.889 | 1-2 | 44 | 1.05 | D | D | Comp. |
| 107 | 0.890 | 1-2 | 25 | 0.60 | B | A | Inv. |
| 108 | 0.948 | 1-2 | 12 | 0.29 | A | A | Inv. |
| 109 | 0.994 | 1-2 | 17 | 0.40 | A | A | Inv. |
| 110 | 0.999 | 1-2 | 44 | 1.05 | D | D | Comp. |
| 111 | 0.886 | 1-3 | 46 | 1.10 | D | D | Comp. |
| 112 | 0.890 | 1-3 | 31 | 0.74 | B | B | Inv. |
| 113 | 0.934 | 1-3 | 25 | 0.60 | B | B | Inv. |
| 114 | 0.998 | 1-3 | 26 | 0.62 | B | B | Inv. |
| 115 | 0.999 | 1-3 | 46 | 1.10 | D | D | Comp. |
| 116 | 0.889 | 1-4 | 47 | 1.20 | D | D | Comp. |
| 117 | 0.892 | 1-4 | 20 | 0.48 | A | A | Inv. |
| 118 | 0.941 | 1-4 | 12 | 0.29 | A | A | Inv. |
| 119 | 0.997 | 1-4 | 17 | 0.40 | A | A | Inv. |
| 120 | 0.999 | 1-4 | 44 | 1.05 | D | D | Comp. |
| 121 | 0.888 | 1-5 | 65 | 1.55 | D | D | Comp. |
| 122 | 0.891 | 1-5 | 41 | 0.98 | B | B | Inv. |
| 123 | 0.957 | 1-5 | 34 | 0.81 | B | B | Inv. |
| 124 | 0.996 | 1-5 | 37 | 0.88 | B | B | Inv. |
| 125 | 0.999 | 1-5 | 55 | 1.31 | D | D | Comp. |
| 126 | 0.889 | 1-6 | 45 | 1.07 | D | D | Comp. |
| 127 | 0.890 | 1-6 | 30 | 0.71 | B | B | Inv. |
| 128 | 0.937 | 1-6 | 16 | 0.38 | A | A | Inv. |
| 129 | 0.997 | 1-6 | 21 | 0.50 | B | B | Inv. |
| 130 | 0.999 | 1-6 | 44 | 1.05 | D | D | Comp. |

Inv.: Present invention,
Comp.: Comparative example

Any of image forming apparatuses No. 102-No. 104 fitted with photoreceptor No. 1-1 having a drive hole with shape shown in FIG. 5(*a*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 101 fitted with photoreceptor No. 1-1 having a drive hole with shape shown in FIG. 5(*a*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 102-No. 104. Image forming apparatus No. 105 fitted with photoreceptor No. 1-1 having a drive hole with shape shown in FIG. 5(*a*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated.

Any of image forming apparatuses No. 107-No. 109 fitted with photoreceptor No. 1-2 having a drive hole with shape shown in FIG. 5(*b*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 106 fitted with photoreceptor No. 1-2 having a drive hole with shape shown in FIG. 5(*b*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 107-No. 109. Image forming apparatus No. 110 fitted with photoreceptor No. 1-2 having a drive hole with shape shown in FIG. 5(*b*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated.

Any of image forming apparatuses No. 112-No. 114 fitted with photoreceptor No. 1-3 having a drive hole with shape shown in FIG. 5(*c*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 111 fitted with photoreceptor No. 1-3 having a drive hole with shape shown in FIG. 5(*c*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 112-No. 114. Image forming apparatus No. 115 fitted with photoreceptor No. 1-3 having a drive hole with shape shown in FIG. 5(*c*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated.

Any of image forming apparatuses No. 117-No. 119 fitted with photoreceptor No. 1-4 having a drive hole with shape shown in FIG. 5(*d*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 116 fitted with photoreceptor No. 1-4 having a drive hole with shape shown in FIG. 5(*d*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 117-No. 119. Image forming apparatus No. 120 fitted with photoreceptor No. 1-4 having a drive hole with shape shown in FIG. 5(*d*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated.

Any of image forming apparatuses No. 122-No. 124 fitted with photoreceptor No. 1-5 having a drive hole with shape shown in FIG. 5(*e*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 121 fitted with photoreceptor No. 1-5 having a drive hole with shape shown in FIG. 5(*e*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 122-No. 124. Image forming apparatus No. 125 fitted with photoreceptor No. 1-5 having a drive hole with shape shown in FIG. 5(*e*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated.

Any of image forming apparatuses No. 127-No. 129 fitted with photoreceptor No. 1-6 having a drive hole with shape shown in FIG. 5(*f*), engaging the photoreceptor with a ratio of a cross-sectional area of the drive hole to another cross-sectional area of an engaging part of a rotation shaft of the image forming apparatus in the range of the present invention exhibited excellent rotation runout accuracy, excellent evenness of halftone image and also excellent fine line reproduction. Image forming apparatus No. 126 fitted with photoreceptor No. 1-6 having a drive hole with shape shown in FIG. 5(*f*), engaging the photoreceptor with a ratio of a cross-sectional area of the drive hole to another cross-sectional area of an engaging part of a rotation shaft of the image forming apparatus smaller than in the range of the present invention exhibited inferior rotation runout accuracy, evenness of halftone image and fine line reproduction to those of image forming apparatuses No. 127-No. 129. Image forming apparatus No. 130 fitted with photoreceptor No. 1-6 having a drive hole with shape shown in FIG. 5(*f*), engaging the photoreceptor with a ratio of a cross-sectional area of the drive hole to another cross-sectional area of an engaging part of a rotation shaft of the image forming apparatus larger than in the range of the present invention exhibited deteriorated evenness of halftone image and fine line reproduction influenced via rotation runout, and took a lot of trouble with attachment to the image forming apparatus, whereby workability was deteriorated. Thus, effects of the present invention were confirmed.

Example 2

Employing image forming apparatuses No. 102, No. 108, No. 118, No. 123 and No. 128 prepared in Example 1, image-writing dot diameter P was changed by changing the optical system as shown in Table 5, writing was conducted at 88 rpm as the number of rotations of the photoreceptor during image-writing, and evenness of halftone images and fine line reproduction were evaluated similarly to the case of Example 1.

Evaluation

Evenness of halftone images and fine line reproduction were evaluated similarly to the method in Example 1. Results evaluated in accordance with the same evaluation ranks as in Example 1 are shown in Table 4.

TABLE 4

| Image forming apparatus No. | *1 | Rotation runout accuracy F (μm) | Dot diameter P (μm) | F/P | Evenness of halftone image | Reproduction |
|---|---|---|---|---|---|---|
| 102 | 1-1 | 31 | 57 | 0.54 | B | B |
| 102 | 1-1 | 31 | 62 | 0.50 | B | B |
| 102 | 1-1 | 31 | 72 | 0.43 | A | A |
| 102 | 1-1 | 31 | 82 | 0.38 | A | A |
| 108 | 1-2 | 12 | 22 | 0.54 | B | B |
| 108 | 1-2 | 12 | 24 | 0.50 | B | B |
| 108 | 1-2 | 12 | 28 | 0.43 | A | A |
| 108 | 1-2 | 12 | 32 | 0.38 | A | A |
| 114 | 1-3 | 26 | 48 | 0.54 | B | B |
| 114 | 1-3 | 26 | 52 | 0.50 | B | B |
| 114 | 1-3 | 26 | 60 | 0.43 | A | A |
| 114 | 1-3 | 26 | 68 | 0.38 | A | A |
| 124 | 1-5 | 37 | 69 | 0.54 | B | B |
| 124 | 1-5 | 37 | 74 | 0.50 | B | B |

TABLE 4-continued

| Image forming apparatus No. | *1 | Rotation runout accuracy F (μm) | Dot diameter P (μm) | F/P | Evenness of halftone image | Reproduction |
|---|---|---|---|---|---|---|
| 124 | 1-5 | 37 | 86 | 0.43 | A | A |
| 124 | 1-5 | 37 | 97 | 0.38 | A | A |

*1: Electrophotographic photoreceptor No.

As is clear from Table 4, it is to be understood that in cases where a ratio of a cross-sectional area of a drive hole to another cross-sectional area of an engaging part of a rotation shaft is 0.890-0.998, images exhibiting excellent (rank A) evenness of halftone image and fine line reproduction can be obtained, when the relationship between rotation runout accuracy F of the photoreceptor and image-writing dot diameter P further satisfies inequality F/P<0.5.

Effect of the Invention

Provided can be en electrophotographic photoreceptor exhibiting excellent evenness of halftone images together with fine line reproduction, and an image forming method thereof, as to a photoreceptor in which an oxytitanium phthalocyanine pigment having a maximum diffraction peak at a Bragg angle (2θ±0.2°) of 27.2° in CuKα X-ray diffraction.

What is claimed is:

1. An electrophotographic photoreceptor comprising a body comprising a cylindrical conductive support provided thereon a photosensitive layer containing an oxytitanium phthalocyanine pigment having a maximum diffraction peak at a Bragg angle (2θ±0.2°) of 27.2° in CuKα X-ray diffraction, and flanges jointed at both ends of the body, wherein at least one of the flanges is fitted with a driving shaft having a drive hole having at least 3 sides, and a ratio B/A of a cross-sectional area B of an engaging part of a rotation shaft to rotate the electrophotographic photoreceptor with respect to another cross-sectional area A of the drive hole is 0.890-0.998.

2. The electrophotographic photoreceptor of claim 1, wherein rotation runout accuracy F of the electrophotographic photoreceptor in relation to image-writing dot diameter P satisfies the following Inequality (1):

$$F/P<0.50. \quad \text{Inequality (1)}$$

3. The electrophotographic photoreceptor of claim 1, wherein rotation runout accuracy F of the electrophotographic photoreceptor in relation to image-writing dot diameter P satisfies the following Inequality (2):

$$0.05<F/P<0.50. \quad \text{Inequality (2)}$$

4. The electrophotographic photoreceptor of claim 1, having a rotation runout accuracy of 10-40 μm.

5. The electrophotographic photoreceptor of claim 1, wherein each of the flanges has a driving shaft length of 2-40 mm.

6. The electrophotographic photoreceptor of claim 1, wherein each of the flanges has a drive hole depth of 4-60 mm.

7. The electrophotographic photoreceptor of claim 1, wherein each of the flanges has a driving shaft diameter of 15-100%, based on a flange diameter.

8. The electrophotographic photoreceptor of claim 1, wherein each of the flanges has a drive hole cross-sectional area of 20-90%, based on a surface area of a surface to provide the driving shaft.

9. An image forming method comprising the steps of charging a cylindrical electrophotographic photoreceptor;

conducting an exposure process to form an electrostatic latent image on the charged electrophotographic photoreceptor;

conducting a developing process to visualize the electrostatic latent image formed on the electrophotographic photoreceptor to a toner image;

transferring the toner image onto a transfer medium; and conducting a cleaning process to remove the toner remaining on the electrophotographic photoreceptor from the electrophotographic photoreceptor, wherein the electrophotographic photoreceptor comprises an electrophotographic photoreceptor of claim 1.

* * * * *